United States Patent [19]

Duverne

[11] Patent Number: 4,526,514

[45] Date of Patent: Jul. 2, 1985

[54] APPARATUS FOR PUMPING A VISCOUS MASS

[76] Inventor: Jean-Claude M. Duverne, 18, rue des Processions, Linas, F 91310 Montlhery, Essonne, France

[21] Appl. No.: 594,709

[22] Filed: Mar. 29, 1984

[30] Foreign Application Priority Data

Apr. 1, 1983 [FR] France ..... 83 05418

[51] Int. Cl.[3] ..... F04B 15/02; F04B 23/00

[52] U.S. Cl. ..... 417/61; 417/207; 210/242.3; 210/923

[58] Field of Search ..... 417/61, 207; 210/242.3, 210/776, 923; 137/13

[56] References Cited

U.S. PATENT DOCUMENTS 2,224,403 12/1940 Lines ..... 137/13 X

FOREIGN PATENT DOCUMENTS 593294 10/1947 United Kingdom ..... 417/61

*Primary Examiner*—Richard E. Gluck

*Attorney, Agent, or Firm*—Rodgers & Rodgers

[57] ABSTRACT

Apparatus comprising a barge or sled adapted to float or slide on the surface of a heavy viscous mass, a pump support frame, a metal net or latticed cage suspended under the pump support frame, the net or cage penetrating the mass to a slight depth to define a surface section of the mass, and a bed of heating resistors disposed slightly above the base of the cage to enter the section to heat and fluidize it sufficiently to be pumped.

7 Claims, 3 Drawing Figures

APPARATUS FOR PUMPING A VISCOUS MASS

This invention deals with an apparatus which permits the pumping of a heavy viscous mass. More specifically, the apparatus according to this invention is designed to allow pumping in a fluid or liquid state a heavy viscous mass lying in open air which, in its original state, could not be pumped without using known methods of much more complexity than the fluidizing and pumping method of this invention.

Accordingly this invention comprises heating a shallow surface section of the heavy viscous mass until it is sufficiently fluidized to be aspirated and propelled over a distance by a pump. The surface heating is accomplished by means of a bed of heating resistors located inside a netted metal cage forming a filter. The resistors penetrate slightly the mass and the cage is suspended under a frame supporting the pump. The frame is in the form of a barge designed to be moved about on the surface of the mass by sliding and/or flotation.

The apparatus is configured in known manner as a barge or sled designed to slide or float on the surface of the heavy viscous mass. Suspended beneath the pump support frame, a metal net or latticed cage penetrates slightly the mass to define a surface section of the mass. A bed of heating resistors is disposed slightly above the base of the cage so that they enter the defined section to heat it sufficiently to fluidize it and thereby allow it to be pumped away.

More specifically, the barge is constructed in known manner in the form of a rectangular frame equipped with longitudinal flotation devices attached along its longer sides and axially supporting the pump and the aspiration and propulsion tubes. Fixed beneath the frame is a metal net cage in the shape of a rectangular parallelepiped in which is distributed a staggered configuration of pin-shaped heating resistors which make up a heating bed of almost the same area as the base of the cage. The upward bent electrical supply leads are situated on each of the long sides of the frame above the upper level of the frame and form lateral bridges to the pump.

Figure 1:
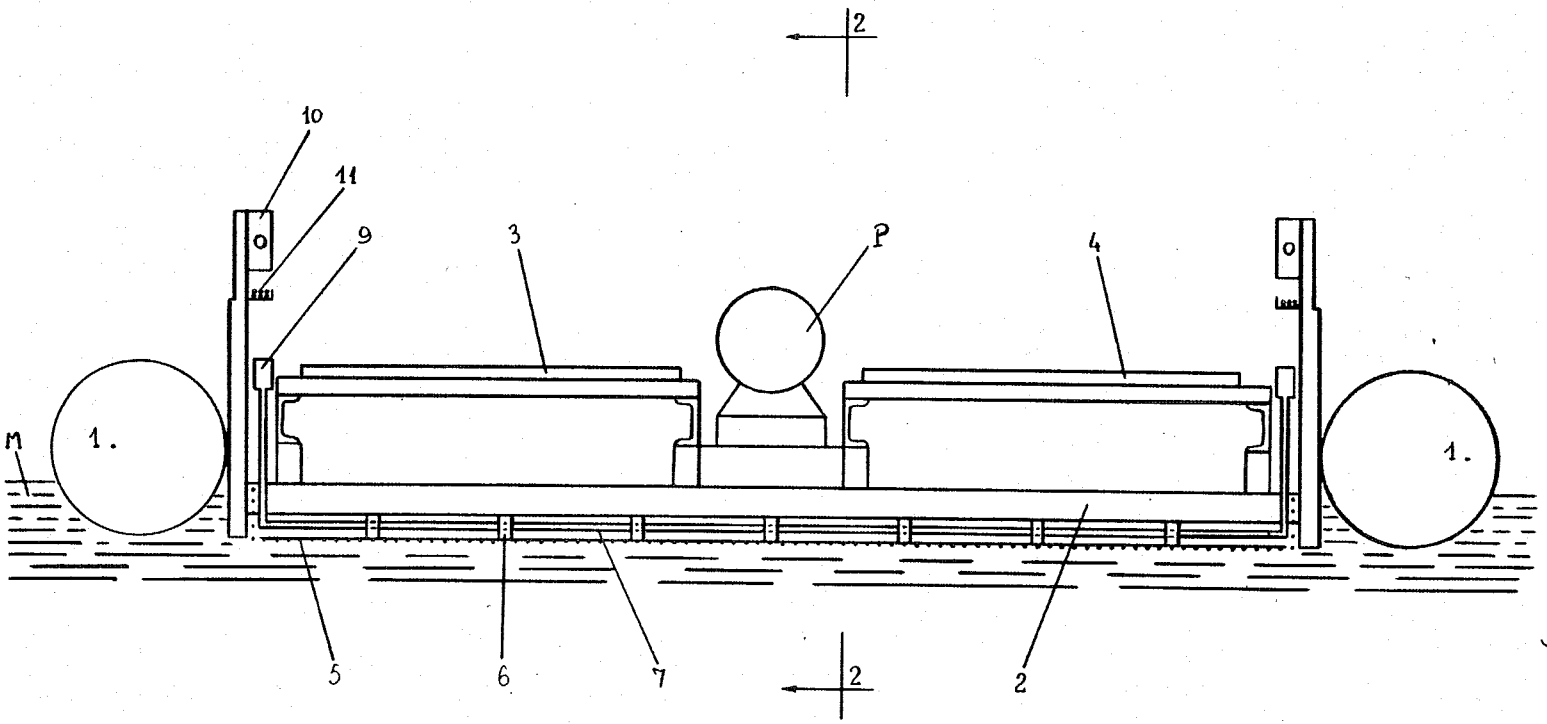
Figure 2:
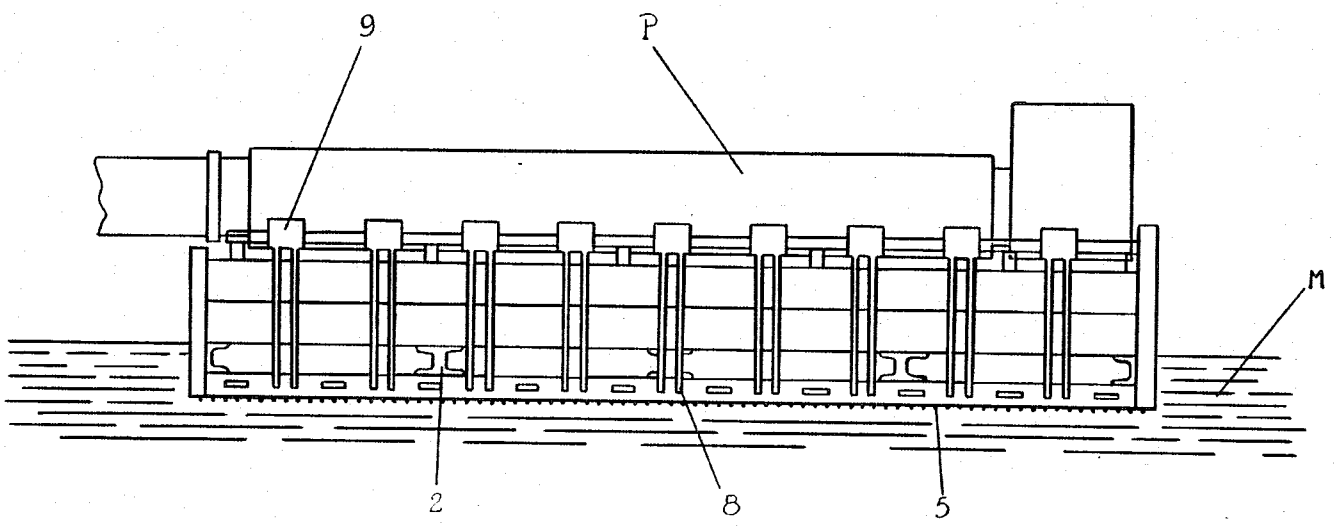
Figure 3:
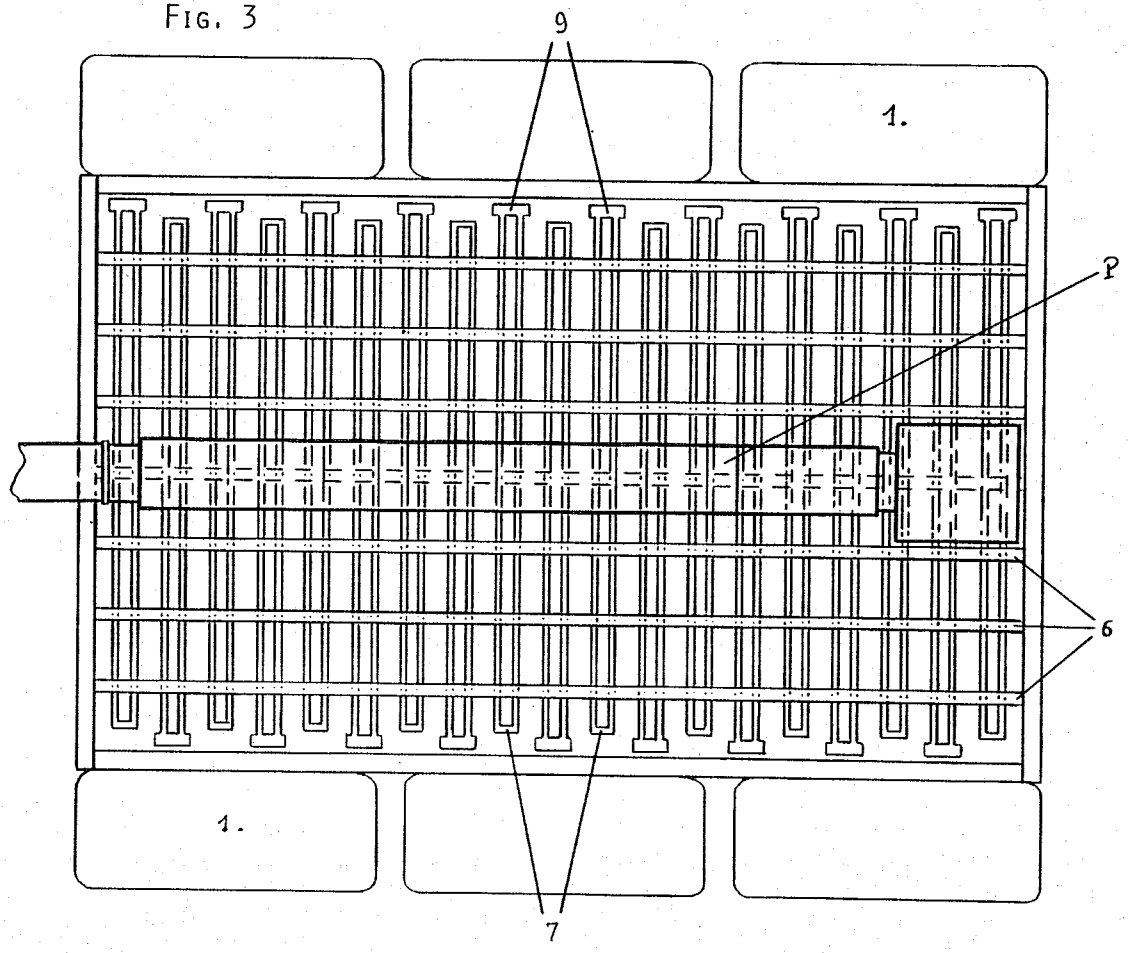

Other features of the invention will become apparent from the following description of an embodiment of the apparatus given as a nonrestrictive example and shown schematically in the attached drawings in which FIG. 1 is a schematic view of a transverse section of the apparatus according to the invention;

FIG. 2 is a longitudinal sectional view taken along the lines 2—2 of FIG. 1; and FIG. 3 is a schematic view from above with the lateral bridges suppressed to show the distribution of the heating resistors.

With reference to the drawings, the apparatus according to this invention, in one embodiment, is made up of a barge with flotation devices 1 and which is capable of floating or sliding on the surface of a heavy viscous mass M. The barge comprises a rectangular frame 2 topped by lateral bridges 3, 4 and axially supports pump P.

Under the frame, a metal net cage 5 is attached by means of cross-pieces 6 in such a way that it penetrates slightly into the mass M. The cage plays the role of a filter or strainer for the surface section of the mass. The mass is fluidized by heating so that it may be pumped.

On the inside of the metal net cage 5, parallel to its base and spaced a slight distance upwardly therefrom, is located a bed 7 of heating resistors. These pin-shaped resistors are staggered as shown in FIG. 3 to cover the greater part of the base of the cage 5. The electrical supply leads of the resistors are bent upwardly on the two sides of the frame. The respective electrical contacts 9 of the heating resistors are located above the upper level of the frame with the electrical wires coming out of a general protective box 10 and following lateral wire paths 11.

Of course, even though not shown in the drawings, the flotation apparatus is vertically adjustable to allow variations in the depth of penetration of the cage and, consequently, the resistors into mass M.

I claim:

1. Apparatus for pumping a heavy viscous mass comprising a barge adapted to slide on the surface of said mass, said barge comprising a frame, a pump fixed to said frame, said pump being in communication with said mass, a net suspended by said frame and penetrating slightly said mass to define a surface section of said mass, and heating means disposed slightly above the base of said net.

2. Apparatus according to claim 1 wherein said frame is of rectangular configuration and wherein flotation devices are disposed respectively on the longer sides of said frame.

3. Apparatus according to claim 1 wherein said pump is adapted to aspirate and propel said surface section.

4. Apparatus according to claim 1 wherein said heating means comprises multiple heating resistors which are fixed to said frame and are disbursed over a surface area of said mass approximately equal to the surface area of said net.

5. Apparatus according to claim 4 wherein said resistors are of a staggered configuration in a plane substantially parallel to the surface of said mass.

6. Apparatus according to claim 4 wherein said frame is rectangular and wherein electrical supply leads are connected to said heating resistors and wherein said leads are bent upwardly on the long sides of said frame.

7. Apparatus for pumping a heavy viscous mass comprising a barge adapted to slide on the surface of said mass, said barge comprising a frame, a pump fixed to said frame, a net suspended by said frame and penetrating slightly said mass to define a surface section of said mass, heating means disposed slightly above the base of said net, and said pump being adpated to aspirate and propel said surface section.

* * * * *